US009038923B2

(12) United States Patent
Robens et al.

(10) Patent No.: US 9,038,923 B2
(45) Date of Patent: May 26, 2015

(54) FLUID LEVEL INDICATOR IN AN AIRLESS FLUID SPRAYER

(75) Inventors: Wayne D. Robens, Lakeville, MN (US); Gregory Wayne Parkhurst, Brooklyn Park, MN (US); James Leo Campbell, Plymouth, MN (US)

(73) Assignee: WAGNER SPRAY TECH CORPORATION, Plymouth, MN (US)

( * ) Notice: Subject to any disclaimer, the term of this patent is extended or adjusted under 35 U.S.C. 154(b) by 314 days.

(21) Appl. No.: 12/754,209

(22) Filed: Apr. 5, 2010

(65) Prior Publication Data

US 2011/0240758 A1 Oct. 6, 2011

(51) Int. Cl.

| | |
|---|---|
| ***B05B 9/08*** | (2006.01) |
| ***B05B 7/24*** | (2006.01) |
| ***B05B 12/08*** | (2006.01) |

(52) U.S. Cl.

CPC ..... *B05B 9/0861* (2013.01); *B05B 7/2402* (2013.01); *B05B 9/0805* (2013.01); *B05B 12/081* (2013.01)

(58) Field of Classification Search

CPC .. B05B 7/2402; B05B 9/0861; B05B 12/081; B05B 9/0805

USPC ..... 239/74, 68, 67, 71, 73, 351, 332; 417/32, 36, 415, 63, 416, 417; 222/14, 222/17, 23, 30, 52, 54, 56, 64–66, 333, 222/481.5; 250/577, 238, 221; 700/281, 700/282

See application file for complete search history.

(56) References Cited

U.S. PATENT DOCUMENTS

| | | | | |
|---|---|---|---|---|
| 1,843,269 | A | | 3/1929 | Casper |
| 1,839,193 | A | | 1/1932 | Blanchard |
| 1,972,955 | A | | 9/1934 | Saugman |
| 2,641,365 | A | | 6/1953 | Lundeen |
| 2,858,965 | A | | 11/1958 | Berman |
| 3,623,661 | A | | 11/1971 | Wagner |
| 3,714,967 | A | | 2/1973 | Zupan et al. |
| 4,093,107 | A | * | 6/1978 | Allman et al. ..... 222/23 |
| 4,147,306 | A | | 4/1979 | Bennett |
| 4,156,505 | A | | 5/1979 | Bennett |

(Continued)

FOREIGN PATENT DOCUMENTS

| | | | |
|---|---|---|---|
| CA | 2568141 | A1 | 5/2008 |
| CN | 1450937 | A | 10/2003 |

(Continued)

OTHER PUBLICATIONS

International Search Report and Written Opinion for corresponding PCT application PCT/US2011/027870, dated Sep. 9, 2011.

(Continued)

*Primary Examiner* — Melanie Tyson
*Assistant Examiner* — Chee-Chong Lee
(74) *Attorney, Agent, or Firm* — Christopher J. Volkmann; Kelly, Holt & Christenson, PLLC

(57) ABSTRACT

The present disclosure generally relates to systems and devices for spraying fluid materials such as paints, stains, and the like, and more specifically, but not by limitation, to a fluid level indicator for an airless fluid sprayer. In one example, an airless fluid sprayer is provided and includes a fluid container, a controller, and a fluid level indication module implemented by the controller to generate an indication of a level of fluid material in the fluid container.

20 Claims, 5 Drawing Sheets

(56) References Cited

U.S. PATENT DOCUMENTS

| | | | | | |
|---|---|---|---|---|---|
| 4,184,778 | A | | 1/1980 | Terrels | |
| 4,260,107 | A | * | 4/1981 | Jackson | 239/74 |
| 4,315,317 | A | * | 2/1982 | Orchard et al. | 700/283 |
| 4,405,088 | A | | 9/1983 | Gray | |
| 4,467,961 | A | * | 8/1984 | Coffee et al. | 239/1 |
| 4,705,995 | A | | 11/1987 | Boll | |
| 4,782,982 | A | | 11/1988 | Ellison | |
| 4,804,109 | A | * | 2/1989 | Vanderjagt | 222/38 |
| 4,919,650 | A | * | 4/1990 | Feingold et al. | 604/67 |
| 5,027,661 | A | * | 7/1991 | Desaulniers et al. | 73/861 |
| 5,086,491 | A | | 2/1992 | Cuneo | |
| 5,395,051 | A | | 3/1995 | Anderson et al. | |
| 5,443,569 | A | | 8/1995 | Uehira et al. | |
| 5,574,657 | A | * | 11/1996 | Tofte et al. | 700/283 |
| 5,626,259 | A | | 5/1997 | Maas et al. | |
| 5,639,219 | A | | 6/1997 | Conatser | |
| 5,860,574 | A | | 1/1999 | Shanklin et al. | |
| 5,979,715 | A | | 11/1999 | Emrick | |
| 6,104,105 | A | | 8/2000 | Schaeffeler et al. | |
| 6,207,052 | B1 | | 3/2001 | Webb | |
| 6,488,846 | B1 | | 12/2002 | Marangi | |
| 6,540,119 | B1 | | 4/2003 | Bensussan et al. | |
| 6,719,058 | B2 | | 4/2004 | Salama et al. | |
| 6,752,330 | B2 | | 6/2004 | DiMaggio et al. | |
| 6,821,096 | B2 | | 11/2004 | Kosmyna et al. | |
| 6,833,072 | B1 | | 12/2004 | Krestine et al. | |
| 6,935,542 | B2 | | 8/2005 | Harrity et al. | |
| 7,102,303 | B2 | | 9/2006 | Brotto | |
| 7,446,493 | B2 | | 11/2008 | Forster et al. | |
| 7,559,438 | B2 | | 7/2009 | Kosmyna et al. | |
| 7,631,789 | B2 | | 12/2009 | Dodd et al. | |
| 8,919,669 | B2 | | 12/2014 | Sandahl | |
| 2004/0262417 | A1 | | 12/2004 | Proch | |
| 2005/0150521 | A1 | | 7/2005 | Jones et al. | |
| 2005/0236498 | A1 | | 10/2005 | Cunningham | |
| 2006/0049099 | A1 | | 3/2006 | Chang | |
| 2007/0000948 | A1 | | 1/2007 | Adler et al. | |
| 2007/0272764 | A1 | | 11/2007 | Poulard | |
| 2008/0217361 | A1 | | 9/2008 | Vitantonio et al. | |
| 2011/0240764 | A1 | | 10/2011 | Sandahl | |
| 2011/0240765 | A1 | | 10/2011 | Sandahl et al. | |

FOREIGN PATENT DOCUMENTS

| | | | |
|---|---|---|---|
| DE | 43 10 014 | | 9/1994 |
| EP | 1 889 665 | | 2/2008 |
| FR | 2 602 437 | | 2/1988 |
| FR | 2861460 | A1 | 4/2005 |
| GB | 1 176 840 | | 1/1970 |
| PT | 1655584 | E | 6/2009 |
| WO | 02/07897 | | 1/2002 |
| WO | 2010/047800 | | 4/2010 |

OTHER PUBLICATIONS

"Epic Integrated Controls", Epic Solutions, 11 pages, accessed Dec. 16, 2009 <www.epicsolutions.us/controls.html#m7>.

International Search Report and Written Opinion for PCT application No. PCT/US2011/027875, dated Jul. 8, 2011.

International Search Report and Written Opinion for PCT application No. PCT/US2011/027876, dated Jul. 7, 2011.

Titan Airless Spray Technology Pro-Finish Series Manual, Dec. 1999, 6 pages.

U.S. Appl. No. 12/754,370, filed Apr. 5, 2010, Application and Drawings. 21 pages.

U.S. Appl. No. 12/774,504, filed May 5, 2010, Application and Drawings. 26 pages.

U.S. Appl. No. 12/754,379, filed Apr. 5, 2010, Application and Drawings. 17 pages.

Wagner Optimus Plus Project Power Painter Owner's Manual, http://www.wagnerspraytech.com. 19 pages, dated Jan. 2009.

Prosecution history from U.S. Appl. No. 12/774,504; including Preliminary Amendment filed Feb. 25, 2011, Requirement for Restriction/Election dated Sep. 26, 2012, Response to Election/Restriction filed Oct. 2, 2012, Non-Final Rejection dated Nov. 30, 2012, Amendment filed Feb. 1, 2013, Final Rejection dated Apr. 11, 2013, Response filed May 15, 2013, Final Rejection dated May 31, 2013, Amendment with RCE filed Jul. 16, 2013, and Non-Final Rejection dated Ma 28, 2014. 88 pages.

Prosecution History from U.S. Appl. No. 12/754,379, including Requirement for Restriction/Election dated Aug. 15, 2012, Response to Election Restriction Requirement filed Sep. 6, 2012, Non-final Rejection dated Dec. 5, 2012, Amendment filed Feb. 4, 2013, Final Rejection dated Jul. 17, 2013, and Amendment with RCE filed Oct. 14, 2013, 56 pages.

Amendment from U.S. Appl. No. 12/774,504 dated Aug. 21, 2014. 8 pages.

First Office Action from Chinese Patent Application No. 201180017649.9, Issuing Date: Oct. 23, 2014, 14 pages with English Translation.

Issue Notification from U.S. Appl. No. 12/754,379 dated Dec. 10, 2014. 1 page.

First Office Action from Chinese Patent Application No. 201180017190.2 Issuing Date: Nov. 3, 2014, 13 pages with English Translation.

First Office Action from Chinese Patent Application No. 201180017645.0, Issue Date: Sep. 2, 2014. 11 pages.

Final Office Action from U.S. Appl. No. 12/774,504, dated Oct. 29, 2014. 13 pages.

Notice of Allowance from U.S. Appl. No. 12/754,379, date: Oct. 29, 2014. 11 pages.

Amendment with RCE for U.S. Appl. No. 12/774,504 dated Jan. 29, 2015, 9 pages.

* cited by examiner

FLUID LEVEL INDICATOR IN AN AIRLESS FLUID SPRAYER

BACKGROUND

An exemplary fluid spraying system comprises a spray-coating system having a device configured to spray fluid material (e.g., paint, ink, varnish, texture, pesticides, herbicides, food products, etc.) through the air onto a surface. The fluid material is typically provided from a fluid container using pressure feed, gravity feed, and/or suction feed mechanisms, for example. For instance, in one exemplary airless paint spraying system a suction tube assembly extends into a paint container to provide paint material to a pump mechanism, which delivers pressurized paint to an output nozzle or tip. An end of the suction tube assembly (which can include a fluid filter, for example) is positioned in the paint material in the container.

The discussion above is merely provided for general background information and is not intended to be used as an aid in determining the scope of the claimed subject matter.

SUMMARY

The present disclosure generally relates to systems and devices for spraying fluid materials such as paints, stains, and the like, and more specifically, but not by limitation, to a fluid level indicator for an airless fluid sprayer.

In one exemplary embodiment, an airless fluid sprayer is provided and includes a fluid container, a controller, and a fluid level indication module implemented by the controller to generate an indication of a level of fluid material in the fluid container.

In one exemplary embodiment, a controller for an airless fluid sprayer is provided. The controller includes a component configured to provide a plurality of current pulses to an electric drive of the airless fluid sprayer, a counter configured to store one or more values indicative of a number of pulses applied to the electric drive, and a fluid level indication module configured to generate an indication of a fluid level based on the counter.

In one exemplary embodiment, a method of generating a fluid container fluid level indication is provided. The method includes applying a plurality of current pulses to an electromagnetic actuator that drives a fluid pump mechanism, maintaining a counter indicative of the plurality of current pulses applied to the electromagnetic actuator, generating a fluid container level indication based on the counter.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
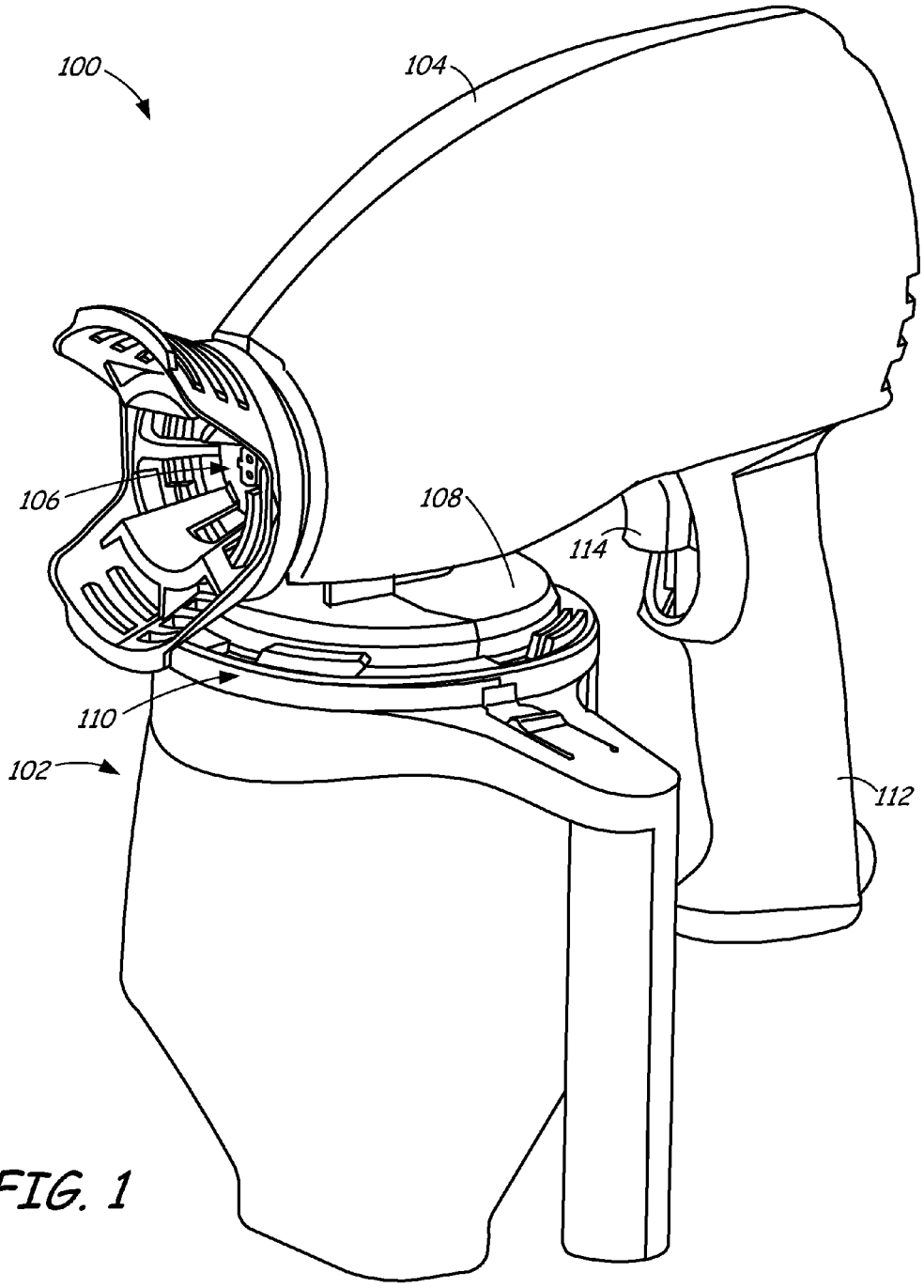
FIG. 1 is a perspective view of an airless fluid sprayer, under one embodiment.

FIG. 1 illustrates a fluid sprayer 100 configured to spray a fluid material (e.g., paints, varnishes, stains, food products, pesticides, inks, etc.) through the air onto a surface. In the embodiment illustrated in FIG. 1, sprayer 100 comprises a handheld spray gun; however, sprayer 100 can include other configurations and can be utilized to spray other types of material.

Spray gun 100 illustratively comprises an airless system and uses a pump mechanism for pumping the paint material from a paint source, illustratively a fluid container 102. In other embodiments, spray gun 100 can comprise an air-driven or air-assisted system.

Spray gun 100 includes a housing 104 containing electrical components for controlling operation of sprayer 100 and an electric drive or motor operably coupled to drive a pump mechanism. The pump mechanism delivers paint from container 102 to an output nozzle 106 having a particular size and shape for generating a desired spray pattern. A suction tube assembly (not shown in FIG. 1) is positioned within container 102 and supplies a fluid path from container 102. In one embodiment, the suction tube assembly extends into housing 104 and/or is attached to a portion of a fluid container cover 108. Cover 108 is supported by housing 104 and/or motor/pump assembly disposed within housing 104.

Spray gun 100 also includes a handle 112 and a trigger 114 that enable a user to hold and control the operation of spray gun 100. A power source (not shown in FIG. 1) supplies power for spray gun 100. For example, the power source can comprise a power cord connected to an alternating current (AC) power source, such as a wall outlet. In another example, the power source can comprise a direct current (DC) power source, such as a battery pack. An exemplary battery pack can include primary (e.g., non-rechargeable) batteries and/or secondary (e.g., rechargeable) batteries. The battery pack can be mounted to spray gun 100 (for example, to handle 112) or can be external and connected to spray gun 100 through a power cord.

Container 102 is removably attached to cover 108 using a connection mechanism (generally illustrated by reference numeral 110), thereby allowing container 102 to be removed for filling, cleaning, etc. In one example, container 102 can be removed from cover 108 and reattached in a different orientation or replaced with a different container, for instance.

Figure 2:
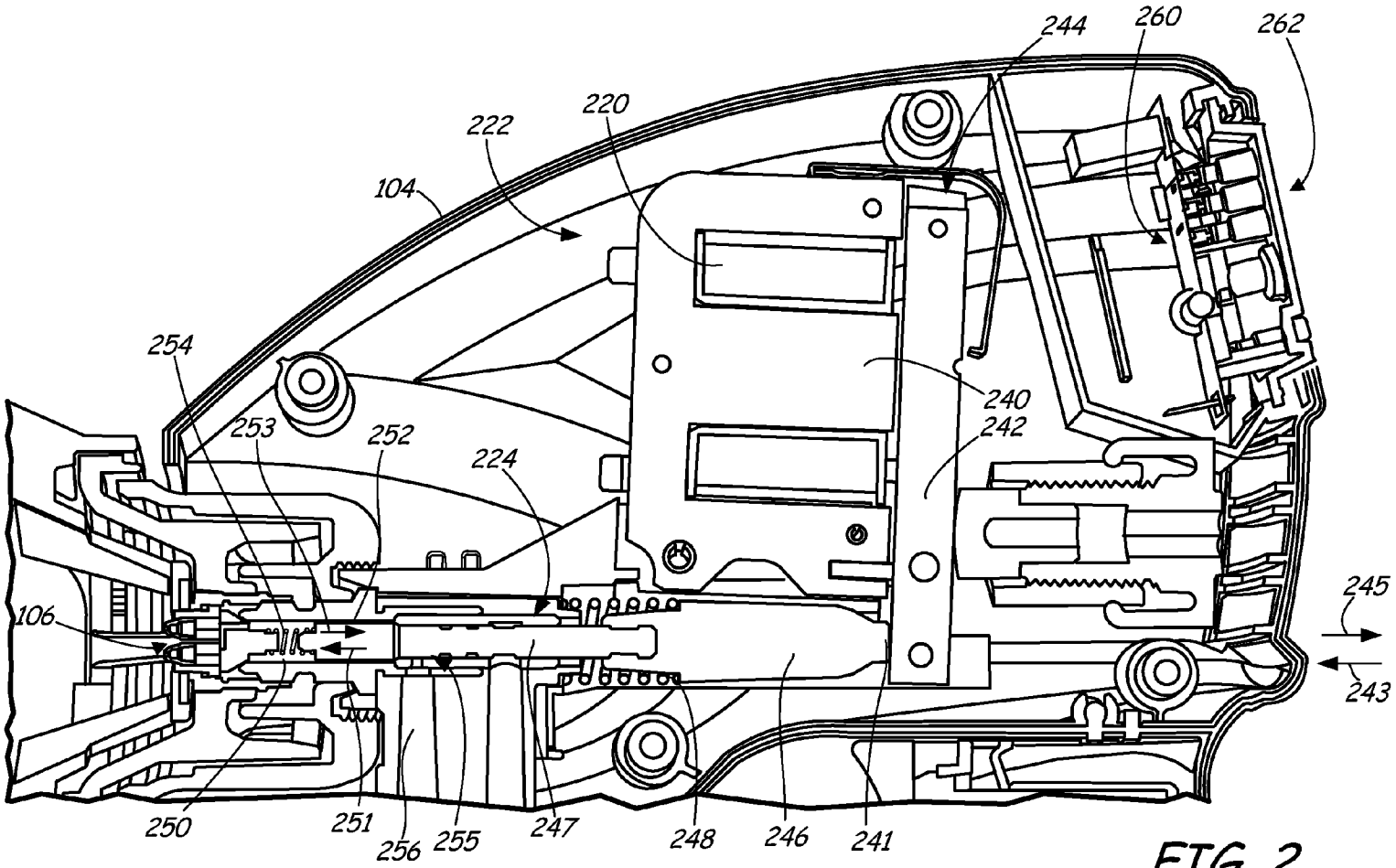
FIG. 2 is a cross-sectional view of the airless fluid sprayer illustrated in FIG. 1, under one embodiment.

FIG. 2 is a cross-sectional view of a portion of spray gun 100 and illustrates some or all of the internal components of housing 104. FIG. 2 illustrates one embodiment of the electric drive that is operable to drive the pump mechanism. As shown, the electric drive comprises a reciprocating electromagnetic actuator 222 that is configured to drive a pump mechanism 224. In one embodiment, actuator 222 operates by applying pulses as a function of an AC power source, for example, to a coil 220 of the actuator 222. In another embodiment, a DC power source (such as a battery pack) can be utilized to provide current to coil 220. In one instance, a controller is configured to utilize the DC power source to provide current pulses to coil 220. In one particular example, the controller provides a "simulated" AC signal using pulse width modulation (PWM), etc.

Reciprocating electromagnetic actuator 222 includes a magnetic armature 242 and coil 220 that is wrapped around at least a portion of a laminated stack (or "core") 240. In the illustrated embodiment, the core/coil assembly is stationary or fixed within the housing 104 while the armature 242 is configured to move or pivot using a pivot assembly 244, for example. Thus, the armature 242 moves in one or more directions 243, 245 with respect to the core/coil assembly based on the current applied to the coil 220. In the illustrated embodiment, when current is applied to the coil 220 the armature 242 is magnetically attracted toward the core 240 (in a direction represented by arrow 243). The force at which the armature 242 is attracted toward the core 240 is proportional to (or otherwise related to) the amount of current applied to the coil 220.

Armature 242 is configured to mechanically contact and drive the pump mechanism. For instance, in the illustrated embodiment armature 242 contacts and drives a plunger 246, which is connected to a piston 247 that moves with a portion of the pump mechanism (for example, within a cylinder). Movement of piston 247 drives fluid through fluid path 250 toward output 106. The fluid is supplied from a fluid source (i.e., fluid container 104) though a fluid tube 256. A check valve 252 is provided in the fluid path 250 and allows fluid flow in a first direction 251. The check value 252 is biased by a spring 254 to limit, or prevent, the flow of fluid in a second direction 253.

A biasing mechanism (illustratively a spring 248) provides a biasing force for piston 247 in a direction 245, which is opposite the direction 243 in which piston 247 is driven by armature 242. In this manner, armature 242 comprises a reciprocating member that moves or oscillates in response to forces applied by spring 248 and the magnetic field interaction between the coil 220 and armature 242. In one embodiment, a surface 241 that contacts the plunger 246 is configured to move in substantially linear directions along a length of the fluid path 250.

To illustrate, during a first action a current is applied to coil 220 causing the armature 242 to actuate piston 247 and drive paint through path 250 to output 106. During a second action, the current in the coil 220 is removed (or otherwise reduced) causing the spring 248 to actuate the piston 247 toward the armature 242. As the piston 247 is actuated by the spring 248 in direction 245, spring 254 closes the check valve 252 and additional fluid is drawn from the fluid container through the fluid tube 256. The additional fluid is then pumped through the fluid path 250 to the output 106 during a subsequent action of the pump mechanism. In one embodiment, the current applied to coil 220 is pulsed between high and low values to cause reciprocation of armature 242 to drive piston 247.

Spray gun 100 also includes electronic components 260, such as a printed circuit board and related components. In one embodiment, electronic components 260 of spray gun 100 can include a controller configured to control operation of spray gun 100. For instance, electronic components 260 can include a microprocessor. Spray gun 100 can also include a control interface 262 that is configured to provide for user input and/or output. For instance, control interface 262 can include one or more user activated buttons for selecting operating modes, for example, and can also include one or more output devices, such as lights (e.g., LEDs, LCDs), audible alarms, and the like.

Figure 3:
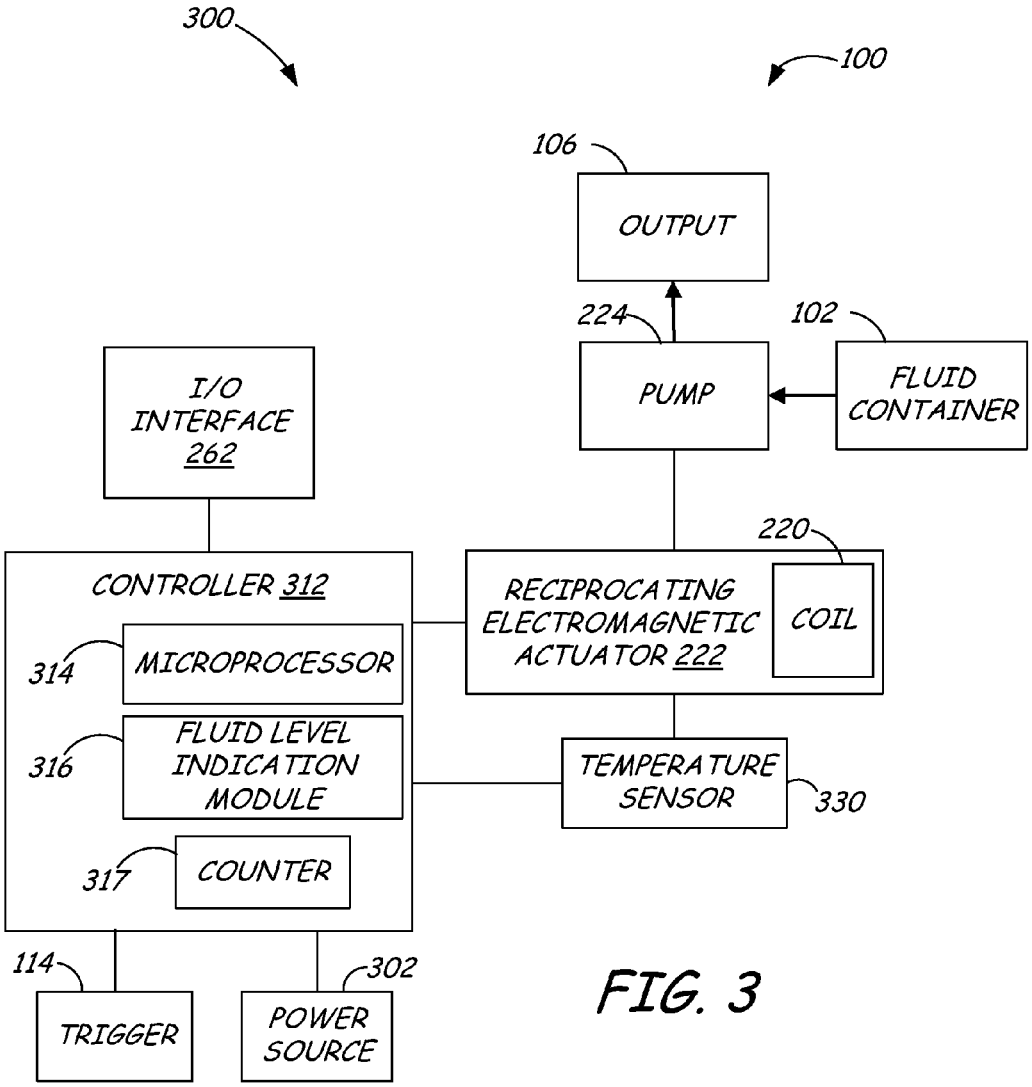
FIG. 3 is a block diagram of an airless fluid sprayer including a fluid level indication module, under one embodiment.

FIG. 3 illustrates a block diagram 300 of spray gun 100, under one embodiment. An AC power source 302 (e.g., power supplied from a wall outlet) supplies power for spray gun 100. In other embodiments, power source 302 can comprise DC power. By way of example, the AC power supplied to spray gun 100 can have voltages ranging from approximately 100 volts (V) AC to approximately 120 VAC, depending on the particular source 302. In some instances, the AC power supplied to spray gun 100 can be up to approximately 240 VAC. Further, depending on the particular source 302 the frequency of the AC power can be 50 hertz (Hz), 60 Hz, etc.

Electromagnetic actuator 222 is configured to drive pump mechanism 224 and deliver pressurized paint material to output 106. At least a portion of the AC current from power source 302 is applied to coil 220 of actuator 222 to drive the fluid pump mechanism 224. The speed and power at which the pump mechanism 224 operates is a function of the amplitude, frequency, and/or phase at which the current waveform is supplied to coil 220.

In accordance with one embodiment, controller 312 is configured to control operation of actuator 222 and pump mechanism 224 by controlling the current applied to coil 220. For example, when trigger 114 is actuated controller 312 uses microprocessor 314 to control the phase, frequency and/or amplitude of current pulses that are applied to coil 220.

By way of example, controller 312 can increase the speed of pump mechanism 224 by increasing the frequency of the current pulses and can decrease the speed of pump mechanism 224 by decreasing the frequency of the current pulses. The frequency of the current pulses applied to coil 220 by controller 312 can be a function of the input AC signal from power source 302 (e.g., the frequency of the current pulses applied to coil 220 can be equal to, double, one-half, one-fourth, or any desired factor of the frequency of the AC power source, for example). In this manner, AC power cycle skipping can be utilized for speed control. To illustrate, in a first exemplary operating mode controller 312 supplies a current pulse to coil 220 on every rising edge of the AC power signal waveform and in a second exemplary operating mode controller 312 supplies a pulse to coil 220 on every other rising edge of the AC power signal waveform.

For power control of actuator 222, controller 312 can be configured to control the amplitude and/or phase of the AC power waveform. For instance, in one embodiment controller 312 performs phase control, or phase cutting, of the AC power source. In one embodiment, controller 312 controls the amplitude(s) of the current pulse(s) applied to coil 220. For example, controller 312 can shape the AC waveform to have a particular amplitude based on a selected operating mode (e.g., low power, medium power, high power, etc.).

Adjusting the power control affects the amount of displacement of each stroke of pump mechanism 224. By way of example, a greater volume of paint material is pressurized by pump mechanism 224 during one stroke in the "high power" operating mode as compared to one stroke in the "low power" operating mode.

It is noted that these are examples for speed and power control and are not intended to limit the scope of the concepts described herein.

User controls for selecting operating modes for spray gun 100 can be provided on an input/output interface 262. Interface 262 provides one or more devices for receiving user input and/or providing feedback to a user, for example. In one embodiment, interface 262 comprises a control panel, such as the exemplary control panel 400 illustrated in FIG. 4.

Exemplary control panel 400 includes a power control button 402 that enables a user to select from one or more power control modes. In the illustrated embodiment, three power control modes (i.e., "low", "medium", and "high") are provided. A visual indicator 406 (illustratively light emitting diodes (LEDs) 408) is provided for indicating the selected power control mode. In one exemplary embodiment, actuator 222 operates at approximately 50 Watts (W), 85 W, and 120 W in the low, medium, and high power modes, respectively.

Control panel 400 also includes a speed control button 404 that enables a user to select from one or more speed control modes. In the illustrated embodiment, three speed control modes (i.e., "slow", "medium", and "fast") are provided. A visual indicator 410 (illustratively light emitting diodes (LEDs) 412) is provided for indicating the selected speed control mode.

As buttons 402 and 404 are pressed by a user, controller 312 operates to generate current pulses applied to coil 220 of actuator 222 based on the selected power and/or speed control modes. By way of example, a user can select a desired power and speed for spray gun 100 based on a particular spraying application. For instance, during use the user can switch between different power and speed modes based on the target spray area (e.g., the user is spraying near an object such as a window, ceiling, floor, etc. and desires increased spray control, for example). The power and speed modes can be selected based on performance of the spray gun 100. One consideration for users of fluid sprayers is the delivery rate of the fluid on the surface. Each job may vary to some extent depending upon the viscosity of the fluid that is being applied, the desired coverage or thickness of the fluid on the surface, the size and shape of the nozzle or tip, as well as myriad other considerations.

In accordance with one embodiment, spray gun 100 can include a temperature sensor 330 that provides feedback to controller 312 indicative of an operating temperature of actuator 222. In one embodiment, temperature sensor 330 comprises a thermocouple embedded in and/or on a laminated stack (i.e., core 240) of actuator 222. Based on a temperature indicated by sensor 330, controller 312 can automatically adjust the operating power and/or speed of actuator 222 and/or activate a warning indicator provided on interface 262. To illustrate, in some instances a maximum operating temperature of a fluid sprayer is constrained by industry safety regulations and standards. Further, actuator 222 may be constrained by a maximum allowable operating temperature to prevent damage to actuator 222 and/or other components of spray gun 100. The automatic adjustment of the power and/or speed by controller 312 is advantageous as it can allow spray gun 100 to be operated at higher power and/or speeds.

In airless fluid sprayers such as spray gun 100, to reduce or prevent sputtering or spitting of the fluid material from the output nozzle or tip it is desired to prevent or otherwise limit air from entering the fluid flow. To illustrate, in spray gun 100 an inlet end of a suction tube assembly is positioned in the fluid material proximate a bottom surface of container 102. If spray gun 100 is operated until fluid container 102 is empty, or substantially empty, the inlet end of the suction tube assembly may be exposed to air in container 102, which can enter the fluid flow path through the suction tube assembly. Upon subsequent use, the air in the fluid flow path can cause sputtering and uneven fluid spray.

In accordance with one embodiment, controller 312 includes a fluid level indication module 316 that is configured to provide an indication of a fluid level in container 102. Module 316 can comprise software, hardware, and/or firmware associated with controller 312. For instance, module 316 can be implemented with processor 314 to monitor the fluid level of container 102, without the use of liquid level sensors in container 102. In accordance with one embodiment, module 316 is configured to generate a low or empty fluid container warning signal that is provided to a user through interface 262. For instance, the warning signal or indicator can be provided to the user when the fluid level in container 102 is at or below a threshold level (e.g., 5 percent remaining, 10 percent remaining, 20 percent remaining, etc.), enabling the user to cease operation of spray gun 100 (for example, to refill container 102) before container 102 is substantially empty and the inlet of the suction tube assembly is exposed to air.

Figure 4:
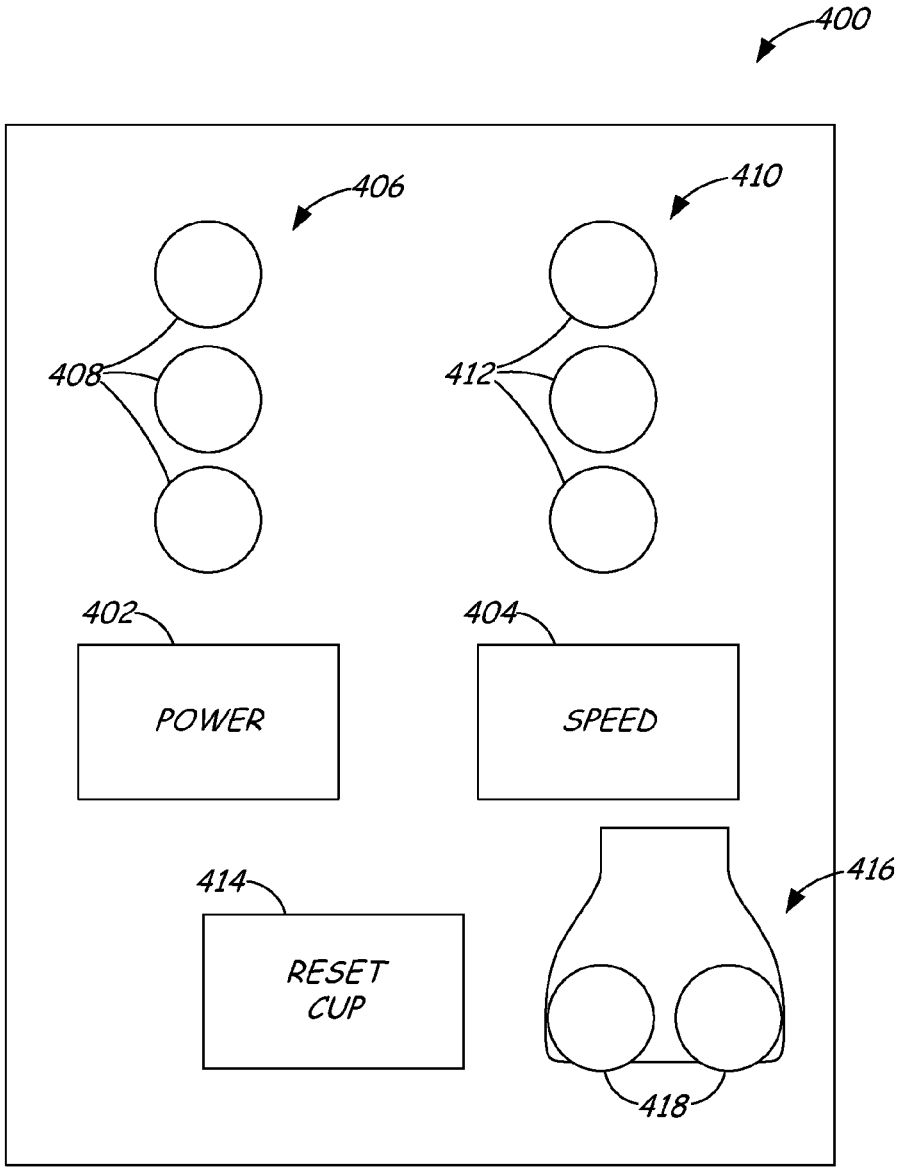
FIG. 4 illustrates an exemplary control interface for an airless fluid sprayer, under one embodiment.

Referring to FIG. 4, in one embodiment controller 312 is configured to activate a fluid level warning indicator 416 provided on panel 400. Indicator 416 comprises a pair of lights 418 (e.g., LEDs, etc.) that are illuminated (e.g., continuously, intermittently, etc.) when the fluid level is at or below the threshold level. It is noted that this is one example of fluid level indicator 416 and other configurations of indicator 416 can be utilized. For example, indicator 416 can include more than or less than two lights 418 and/or can include audible alarms and the like.

In one embodiment, fluid level indication module 316 of controller 312 generates a fluid level warning signal based on one or more of the selected speed and power control modes. For example, in one embodiment the fluid level indication module 316 generates the fluid level warning signal as a function of the number of the pulses applied to coil 220. In another embodiment, the fluid level indication module 316 generates the fluid level warning signal as a function of the number of pulses applied to coil 220 and the displacement of each pump stroke (i.e., the amplitude of each pulse).

As illustrated in FIG. 3, controller 312 includes a counter 317. In one embodiment, counter 317 is indicative of the number of pulses applied to coil 220. Alternatively, or in addition, counter 317 can be indicative of the volume of fluid pumped from pump mechanism 224. For example, counter 317 can contain a value based on the number of strokes of the pump (i.e., the number of pulses applied to coil 220) and the displacement of each stroke (i.e., the amplitude of each pulse applied to coil 220). The value of counter 317 is compared to a threshold to generate the fluid level warning signal. For instance, the controller 312 can store thresholds values for different container sizes (e.g., one pint, one quart, one gallon, five gallon, etc.) in a look-up table, for example. Based on a default or a user-defined fluid container size, the controller 312 determines the appropriate threshold value that is compared to counter 317 to generate the fluid level warning signal.

Figure 5:
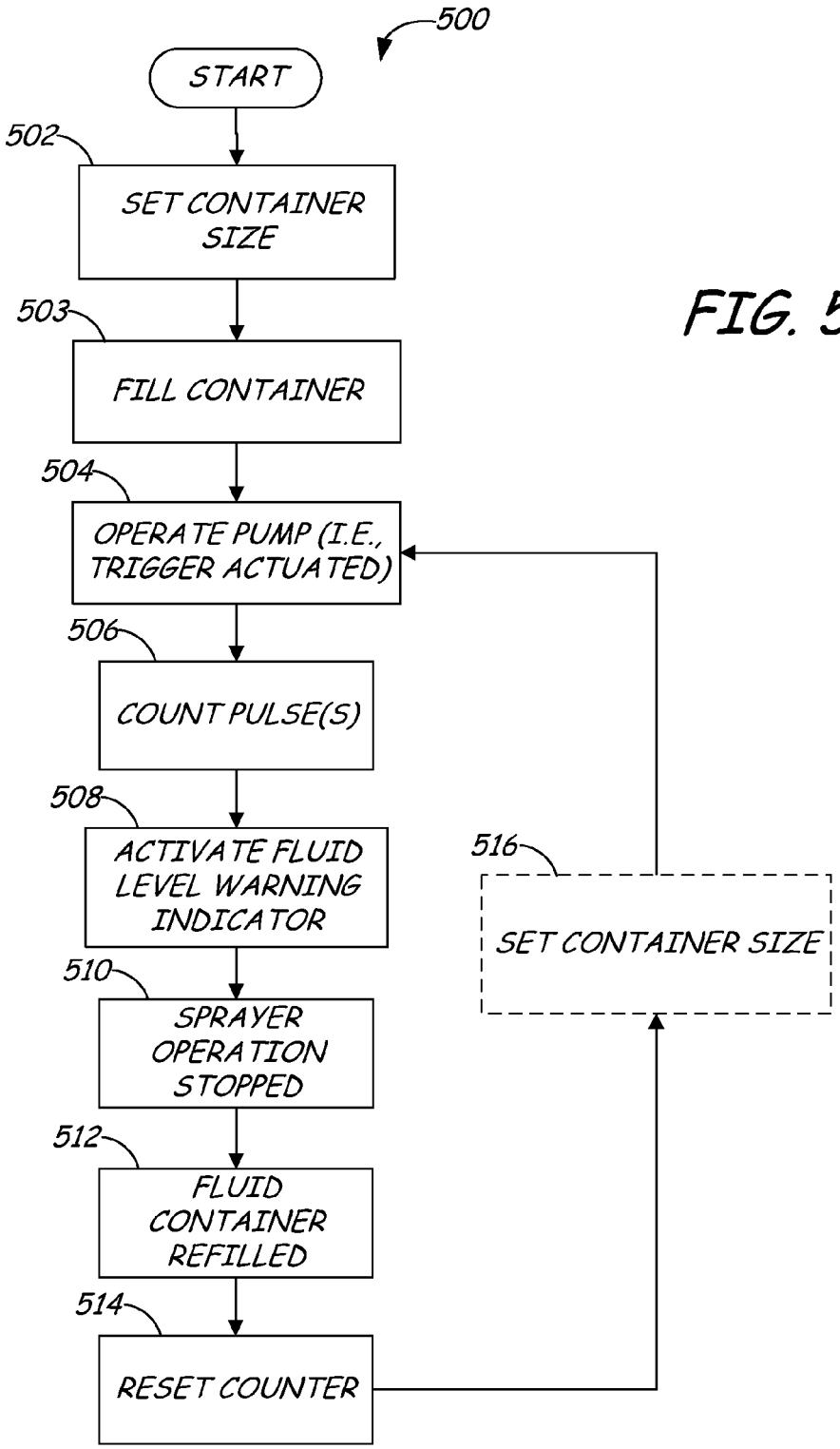
FIG. 5 is a flow diagram of a method for providing fluid level indication, under one embodiment.

FIG. 5 is a flow diagram illustrating a method 500 for providing a fluid level warning indicator, under one embodiment. For illustration purposes, method 500 will be described in the context of schematic diagram 300 of airless spray gun 100. However, it is noted that method 500 can be utilized in other types of fluid spraying systems and devices.

At step 502, controller 312 of spray gun 100 is set for a particular container size. For example, controller 312 can be set at manufacture for a default container size (e.g., one quart, one gallon, etc.). Alternatively, or in addition, step 502 can comprise receiving an input from the user indicative of the size of container 102 being used. The fluid container 102 is filled with fluid at step 503. In one example, the fluid container 102 is filled by the user to (or above) a specific known level. For instance, the fluid container 102 can include visual markings (i.e., a "fill to" line). The user can fill the fluid container to or above the markings.

At step 504, the fluid pump mechanism 224 is operated in response to the user actuating trigger 114 based on a selected power and speed control mode. The number of pulses applied to coil 220 are stored by counter 317. In one embodiment, counter 317 stores data indicative of a volume of fluid sprayed and/or remaining in container 102.

At step 508, controller 312 uses counter 317 to determine whether the fluid level remaining in container 102 is at or below a threshold (i.e., a threshold selected based on the container size set at step 502). In one embodiment, when the threshold is reached controller 312 activates indicator 416.

At step 510, operation of spray gun 100 is stopped before the fluid container 102 is empty, or substantially empty, and the inlet of the suction tube assembly is exposed to air. In one embodiment, operation of spray gun 100 is stopped by the user releasing the trigger in response to seeing indicator 416. In another embodiment, operation of spray gun 100 can be automatically stopped by controller 312.

At step 512, the user refills fluid container 102. Counter 317 is reset at step 514, for example by the user pressing a reset button 414 on control panel 400 illustrated in FIG. 4. In one embodiment, an optional step 516 can comprise changing the container size set in controller 312 at step 502. For example, controller 312 can utilize the previous value of counter 317 (i.e., when reset button 414 was pressed) to set or adjust the threshold used during subsequent operation. In this manner, fluid level indication module 316 can accommodate changes in container size.

In one embodiment, a user interface component can be provided that allows the user to select the particular container size being used. For example, in one embodiment control panel 400 can include a control that allows that user to specify the container size (e.g., one pint, one quart, one gallon, etc.). The threshold for counter 317 is adjusted based on the selected container size.

Use of controller 312 and fluid level indication module 316 to provide fluid level indications can be advantageous in at least several respects. For instance, conventional liquid level sensors can be frequently inaccurate and depend greatly on the orientation of the fluid container (i.e., different readings based on different tilts/angles of the container). Further, conventional liquid level sensors are often hard to read and interpret, and can go unnoticed by the user. For example, a user may fail to acknowledge the liquid level sensor and operate the system until the fluid level is empty. The use of controller 312 and fluid level indication module 316 provides an accurate and cost-effective mechanism to provide fluid level information to the user.

While various embodiments of the invention have been set forth in the foregoing description, together with details of the structure and function of various embodiments of the disclosure, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application for the system or method while maintaining substantially the same functionality without departing from the scope and spirit of the present disclosure and/or the appended claims.

What is claimed:

1. A paint sprayer comprising:

a paint container;

a paint pump configured to pump paint from the paint container;

a spray nozzle configured to spray paint pressurized by the paint pump;

an electric drive mechanism that activates the paint pump in response to application of current pulses;

a controller including:

a paint level indicator that provides feedback to the user indicative of the paint in the paint container being below a threshold level;

a counter that stores a count indicative of current pulses applied to the electric drive mechanism; and a processor that:

compares the count from the counter to a current pulse threshold value; and activates the paint level indicator to provide the feedback based on the comparison.

2. The paint sprayer of claim 1, wherein the processor comprises a microprocessor.

3. The paint sprayer of claim 1, wherein the electric drive mechanism comprises a reciprocating electromagnetic actuator and the current pulses are applied by the controller to the electromagnetic actuator.

4. The paint sprayer of claim 3, wherein the controller generates the indication based on at least one of a number of the pulses applied to the electromagnetic actuator and an amplitude of the pulses applied to the electromagnetic actuator.

5. The paint sprayer of claim 1, wherein the threshold value is user-adjustable and indicative of a threshold number of current pulses.

6. The paint sprayer of claim 1, and further comprising a control mechanism configured to be implemented by a user to reset the counter, wherein the threshold value is adjusted in response to the user resetting the counter.

7. The paint sprayer of claim 1, wherein the controller does not require a signal from a fluid level sensor in the paint container to generate the indication.

8. The paint sprayer of claim 1, wherein the controller is configured to:

apply a plurality of current pulses to an electromagnetic actuator that drives the paint pump;

maintain the counter indicative of the plurality of current pulses applied to the electromagnetic actuator; and generate the indication based on a value of the counter.

9. The paint sprayer of claim 8, wherein the controller s configured to compare the value from the counter to a threshold value.

10. The paint sprayer of claim 9, wherein the counter stores the value indicative of the number of current pulses applied to the electromagnetic actuator.

11. The paint sprayer of claim 10, wherein the value stored in the counter is indicative of an amplitude of each of the number of current pulses applied to the electromagnetic actuator.

12. The paint sprayer of claim 1, wherein the paint sprayer comprises a handheld airless paint sprayer.

13. The paint sprayer of claim 12, wherein the paint container is removably attached to the handheld airless paint sprayer.

14. The paint sprayer of claim 1, and further comprising a temperature sensor configured to provide an indication to a controller indicative of a temperature of the paint sprayer.

15. The paint sprayer of claim 1, wherein the feedback comprises at least one of an audible alarm and a visual alarm.

16. The paint sprayer of claim 15, wherein the feedback comprises an illuminated light on the paint sprayer.

17. A paint sprayer comprising:

a paint pump configured to pump paint from a paint container;

a spray nozzle configured to spray paint pressurized by the paint pump;

a user activated control;

an electric drive mechanism that activates the paint pump in response to application of current pulses; and a controller that:

determines a number of current pulses applied to the electric drive mechanism;

compares the number of current pulses to a threshold value that is user-adjustable;

generates an indication of a level of paint in the paint container based on the comparison; and adjusts the threshold value in response to a user activated control.

18. The paint sprayer of claim 17, wherein the controller maintains a counter for the number of current pulses, and wherein the user activated control comprises a control that resets the counter.

19. The paint sprayer of claim 18, wherein the adjusted threshold value is based on a value of the counter when the counter is reset.

20. The paint sprayer of claim 19, wherein the controller is configured to:

determine a second number of current pulses applied to the electric drive mechanism after the counter is reset;

compare the second number of current pulses to the adjusted threshold value; and generate a second indication of a level of paint in the paint container based on the comparison.

* * * * *